US007461838B2

(12) United States Patent
Hendricks et al.

(10) Patent No.: US 7,461,838 B2
(45) Date of Patent: Dec. 9, 2008

(54) SPACED APART SEGMENT WHEEL ASSEMBLY FOR A CARTON PACKAGING MACHINE

(75) Inventors: Timothy W. Hendricks, Acworth, GA (US); Jeff Disrud, Acworth, GA (US); Frank Moncrief, Acworth, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 464 days.

(21) Appl. No.: 11/252,526

(22) Filed: Oct. 18, 2005

(65) Prior Publication Data

US 2007/0085260 A1 Apr. 19, 2007

(51) Int. Cl.
*B65H 5/22* (2006.01)

(52) U.S. Cl. ..... 271/5; 271/11; 271/107

(58) Field of Classification Search ..... 271/5, 271/11, 107; 493/122, 123, 125
See application file for complete search history.

(56) References Cited

U.S. PATENT DOCUMENTS 2,827,287 A * 3/1958 Gross et al. ..... 271/11
4,767,390 A * 8/1988 Herring ..... 493/88
5,125,637 A * 6/1992 Glaser ..... 271/11
6,497,084 B1 12/2002 Janen

FOREIGN PATENT DOCUMENTS

| | | |
|---|---|---|
| EP | 0 970 885 A1 | 1/2000 |
| EP | 1 262 410 A1 | 12/2002 |
| EP | 1 342 668 A1 | 9/2003 |
| WO | WO 00/23325 | 4/2000 |

* cited by examiner

*Primary Examiner*—David H Bollinger
(74) *Attorney, Agent, or Firm*—Womble Carlyle Sandridge & Rice, PLLC

(57) ABSTRACT

An improved segment wheel assembly for an article packaging machine is provided for picking individual carton blanks from a magazine and delivering the carton blanks to a conveyor to be carried to a packaging station of the machine. The segment wheel assembly has a pair of generally cylindrical segment wheels spaced apart from each other in end-to-end relationship. An unobstructed space is defined between the spaced segment wheels and each segment wheel has a generally rectangular cutout with the cutouts being aligned. A pick arm assembly including suction cups is disposed within the unobstructed space. A drive train rotates the segment wheels in unison and, simultaneously, oscillates the suction cup back and forth within the unobstructed space. The suction cup repeatedly grabs single carton blanks from the magazine and pulls them toward the rotating segment wheels, whose cutouts engage each carton blank and urges it toward and into the conveyor.

17 Claims, 5 Drawing Sheets

SPACED APART SEGMENT WHEEL ASSEMBLY FOR A CARTON PACKAGING MACHINE

TECHNICAL FIELD

This invention relates generally to carton packaging machines and more particularly to segment wheel assemblies of such machines for picking single carton blanks from a magazine and delivering the carton blanks to a conveyor.

BACKGROUND

It is well known in carton packaging machines to utilize segment wheel assemblies to pick single carton blanks from a magazine of back-to-back blanks and position the blanks on a conveyor. The conveyor generally then transports the carton blanks to in a single file end-to-end relationship to an area of the packaging machine where they are folded around or packed with articles such as, for example, beverage cans. U.S. Pat. No. 6,497,084 of Janen, which is owned by the assignee of the present invention, discloses a carton blank transport apparatus that includes a traditional segment wheel assembly and conveyor for the aforementioned use, and this patent is hereby incorporated fully by reference.

FIGS. 1 and 2 below illustrate in somewhat simplified form a traditional and well known prior art segment wheel assembly found in carton packaging machines. The prior art assembly 11 comprises a first segment wheel 12, generally in the shape of a disc, and a similar second segment wheel 13, that are mounted in spaced relationship on a rotatable segment wheel shaft 14. The segment wheel shaft 14 is continuous and extends between the segment wheels 12 and 13. The segment wheels 12 and 13 ride on respective nip rollers 22 and 23, which also are rotatable. As shown in FIG. 2, each segment wheel is formed with a somewhat crescent-shaped cut-out 26 for purposes detailed below.

A pair of pick arms 16 and 17 are mounted on a pick arm shaft 18 disposed above the segment wheels. The pick arms extend downwardly between the segment wheels and are provided at their lower ends with suction cups 19 and 21. Of course, associated suction lines, side plates, bearings, sprockets, and gears are associated with the segment wheel assembly 11 to operate the assembly as described below. Such associated machinery is well known in the art and thus need not be described in detail here.

FIG. 2 illustrates typical operation of the prior art segment wheel assembly an is a view taken along line A-A of FIG. 1 so that only segment wheel 13 and pick arm 17 are shown. It will be understood that the other segment wheel and pick arm operate identically. In operation, a horizontal back-to-back stack of carton blanks 32 is located in a magazine adjacent the downstream end of the segment wheel assembly. The segment wheel 13 is rotated in a counterclockwise direction at a predetermined speed, as indicated by arrow 28, while the nip roller 23 is rotated in a clockwise direction as indicated by arrow 29. As the segment wheel and nip roller are rotated, the pick arm 17 is articulated back and forth by the articulating pick arm shaft 18, as indicated by arrows 31. The range of articulation is predetermined so that the suction cup 21 swings toward and contacts a carton blank on the end of the stack 32.

The suction cup grabs the end blank of the stack and, as the pick arm begins to articulate back, pulls the blank to the right in FIG. 2 against the rotating segment wheel 13. The timing of this motion is such that the cutout 26 of the rotating segment wheel 13 passes the top of the carton blank, which drops into the cutout. The pick arm then releases the blank and articulates on up to the right and out of the way. As the segment wheel continues to rotate, the lip 27 of its cutout 26 pulls or urges the top of the carton blank down against the rotating nip roller 23. The blank then becomes captured between the nip roller and the segment wheel and is thereby drawn to the right and delivered to a conveyor (not shown), which conveys the blank to the right as indicated by arrow 33 to be delivered to a packaging area of the packaging machine. The just described motion of the segment wheel assembly repeats over and over. In this way, carton blanks are drawn one at a time from the stack 32 and delivered in single file edge-to-edge relationship to the conveyor.

While prior art segment wheel assemblies have proven reasonably successful, they nevertheless have been plagued with various problems and shortcomings inherent in their designs. The most serious of these, perhaps, is the fact the pick arm must be highly curved and convoluted as shown in FIG. 2 in order to avoid hitting the segment wheel shaft 14 as the pick arm articulates. A closely related problem is that the lower end of the pick arm and thus the suction cup 21 also must be located relatively low so that it does not hit the segment arm shaft during operation. This means that the suction cup necessarily engages and grabs the carton blanks of the stack at a location substantially below the top edges of the blanks. This, in turn, causes a number of problems. For instance, since the blanks are being pulled against the segment wheels from a low position, substantial bowing of the blanks as they engage the segment wheels can occur. This bowing can cause flaps in the blank to pop open, misalignment of the blanks as they are delivered to the conveyor, and even machine jams on occasion. It would be much more desirable to grab the carton blanks nearer their top edges where end flaps typically are located. However, this has not been possible in the past because of the requirement that the suction cups clear the segment wheel shaft 14 as they move back and forth.

Accordingly, a need exist for an improved segment wheel assembly in which carton blanks are picked from a stack at or near their top edges rather than nearer their middle portions. More generally, a need exists for a segment wheel assembly wherein suction cups of the pick arm assembly can be positioned to engage blanks at any desired location. A further need exists for a segment wheel assembly with a simpler, more space efficient, and less convoluted pick arm configuration. It is to the provision of a segment wheel assembly that addresses these and other needs that the present invention is primarily directed.

SUMMARY OF THE INVENTION

Briefly described, the present invention, in one preferred embodiment thereof, is an improved segment wheel assembly that addresses the problems and shortcomings of the prior art. The segment wheel assembly comprises a pair of spaced apart segment wheels in the shape of horizontally aligned cylinders closed at one end. Each segment wheel or cylinder has a separate shaft secured to and projecting from its closed end and the shafts are rotatably journaled in appropriate bearings on respective side plates of the assembly. Thus, unlike the prior art, there is no segment wheel shaft that extends across the entire assembly. Instead, the space between the facing ends of the segment wheels is open and free of any obstruction. Each segment wheel cylinder is machined with an open slot along one side and the slots of each segment wheel also are aligned with each other. The drive train of the assembly rotates each of the separated aligned segment wheels in unison so that the slots always align and rotate with each other.

A pair of pick arms are mounted on an articulating shaft above the segment wheels. The pick arms extend downwardly into the open and unobstructed space between the facing ends of the segment wheels and are provided on their lower end portions with suction cups for grabbing carton blanks from a magazine as described above. Since the space between the segment wheels is open and unobstructed, the pick arms can be straight or substantially straight, or at least less convoluted as needed, because there is no shaft in the space to be avoided as the arms articulate. More importantly, however, the suction cups can be positioned on the pick arms so that they engage cartons in the magazine at or near the top edges of the cartons or at any more desirable location. Thus, the problems caused in the prior art from bowing of cartons during the selection process is eliminated. Further, since the pick arms are simpler, the space between the segment wheels can be narrower than in the prior art, which, in combination with the more desirable selection of carton blanks from their top edges, allows the assembly to function with narrower carton blanks than the prior art.

These and other features, objects, and advantages of the spaced segment wheel assembly of this invention will become more apparent upon review of the detailed description set forth below, when taken in conjunction with the accompanying drawing figures, which are briefly described as follows.

DETAILED DESCRIPTION OF THE PREFERRED EMBODIMENTS

Figure 1:
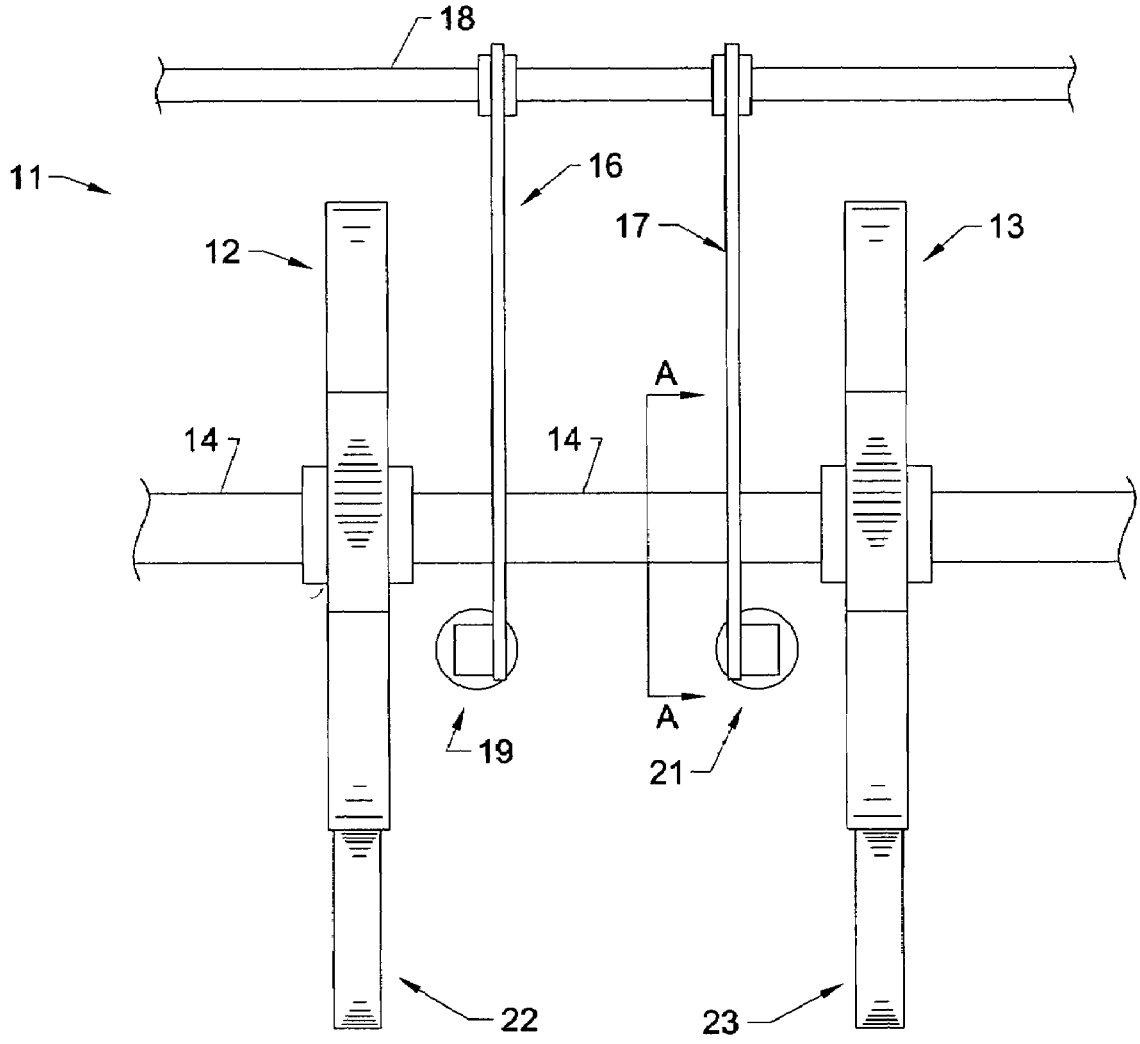
Fig. 1 (Prior Art)
FIG. 1 illustrates key components of a typical prior art segment wheel assembly, discussed above, as seen from the upstream end thereof.
Figure 2:
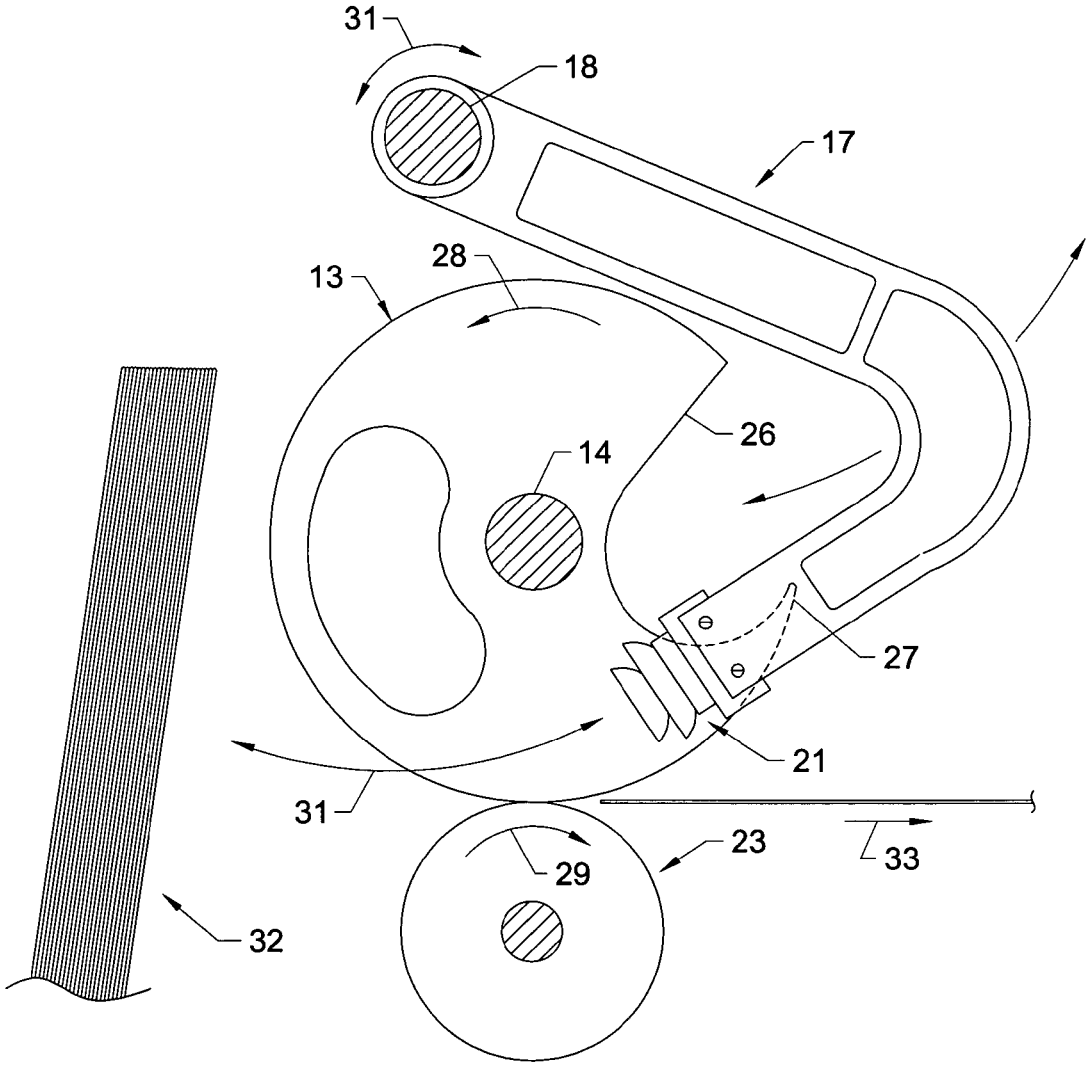
Fig. 2 (Prior Art)
FIG. 2 is a view of the prior art segment wheel assembly taken along line A-A of FIG. 1 and illustrating typical operation of such assemblies and the problems caused by the continuous segment wheel shaft.
Figure 3:
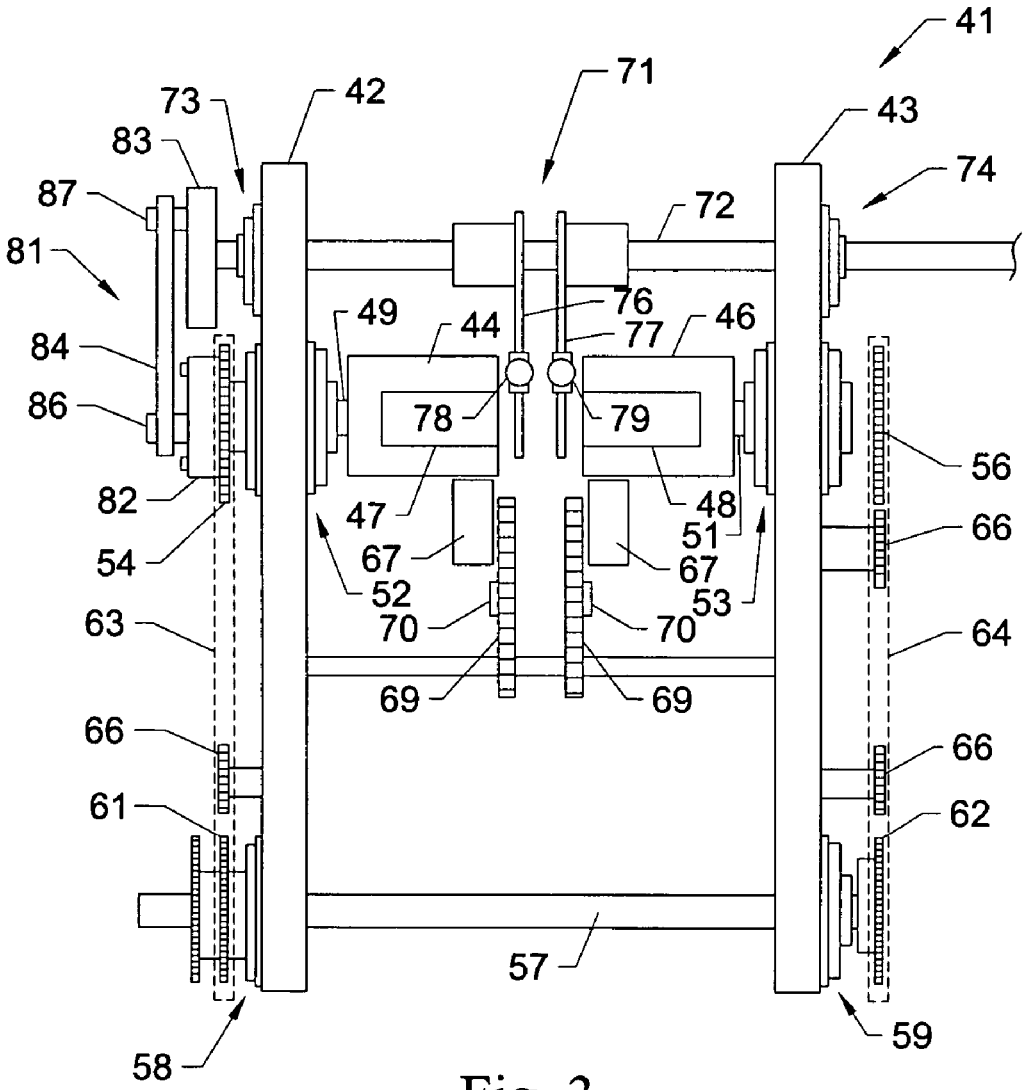
FIG. 3 is an end view, from the upstream end thereof, of a segment wheel assembly that embodies principles of the present invention in a preferred form.

FIGS. 1 and 2, which illustrate the prior art, have been discussed above in the Background section. Reference is now made in more detail to the remaining drawing figures, which illustrate the present invention in a preferred embodiment considered by the inventors to be the best mode of carrying out the invention. FIG. 3 is a view of the segment wheel assembly of this invention as seen from the downstream end thereof; that is, from the end to which stacked back-to-back carton blanks are fed from a magazine. The segment wheel assembly 41 comprises a first side plate 42 and a second side plate 43, between which key components of the assembly are supported. A first segment wheel 44 is rotatably mounted to side plate 42 and a second segment wheel is rotatably mounted to side plate 43. More specifically, the first segment wheel is configured as a cylinder that is open on its right hand side in FIG. 3 and closed at its left hand side. A generally rectangular cutout 47 is formed on one side of the segment wheel 44 and a shaft 49 is fixed to and projects to the right of the closed end of the segment wheel. The shaft 49 is rotatably journaled in and extends through a bearing assembly 52 mounted to the end plate 42. A sprocket 54 is mounted to the end of the shaft 49 on the outside of the end plate 42. It will thus be seen that rotation of the sprocket 54 causes the segment wheel 44 likewise to rotate.

Similarly, a second segment wheel 46, which is a mirror image of the first segment wheel 44, has a rectangular cutout 48 and is rotatably mounted to the end plate 43 by means of a shaft 51 that is journaled in and extends through a bearing assembly 53. A sprocket 56 is mounted to the end of the shaft 51 on the outside of end plate 43 so that rotation of the sprocket 56 causes the second segment wheel 46 likewise to rotate. The cylindrical segment wheels are mounted in opposed horizontally aligned and spaced apart relationship with respect to each other. Most significantly, since the shafts 49 and 51 are fixed to the closed ends of the segment wheels 44 and 46 respectively, there is no shaft that extends across the entire width of the assembly as in the prior art. Thus, the space between the opposed segment wheels 44 and 46 in the center of the assembly is completely open and unobstructed.

A drive shaft 57 extends between the end plates 42 and 43 at the bottom of the assembly and its ends are rotatably journaled in and extend through respective bearing assemblies 58 and 59. A sprocket 61 is secured to the left hand end, in FIG. 3, of the drive shaft 57 on the outside of end plate 42. Similarly, a sprocket 62 is secured to the right hand end of the drive shaft 57 on the outside of end plate 43. A drive chain 63 (shown here in phantom line for clarity of illustration) extends around the sprocket 54 and the sprocket 61 on the left of the assembly and is appropriately tensioned by means of an idler sprocket 66. Similarly, a drive chain 64 (shown in phantom line) extends around sprocket 56 and sprocket and sprocket 62 on the right side of the assembly and is appropriately tensioned by idler sprockets 66. With this arrangement, it will be appreciated that rotation of the drive shaft 57 by a drive motor (not shown) causes the segment wheels 44 and 46 to rotate in unison. Further, the sizes of the sprockets are selected so that the segment wheels rotate at the same rate of rotation. In this way, the rectangular cutouts 47 and 48 formed in respective segment wheels 44 and 46 remain always aligned with each other, as illustrated, as the segment wheels are rotated by rotation of the drive shaft 57.

Nip rollers 67, which preferably are made of a rubberized or otherwise high friction material, are mounted beneath the segment wheels 44 and 47 and may engage the segment wheels. The nip rollers may be separately rotatable at a desirable speed or may rotate with the segment wheels. Conveyor chains 69 are shown between the nip rollers. The conveyor chains 69 are part of a conveyor assembly that extends downstream of the segment wheel assembly and to which carton blanks are fed by the segment wheel assembly. The conveyor assembly itself is traditional and not part of the present invention and thus it is not shown or described in detail here. However, reference is made to U.S. Pat. No. 6,497,084 incorporated by reference above, which discloses a typical packaging machine conveyor assembly. The conveyor chains 69 may include dogs 70, which, as is known in the art, align and space single carton blanks on the conveyor assembly as the blanks are conveyed from the segment wheel assembly 41 to downstream areas of the packaging machine where they are packed with articles such as, for instance, beverage cans.

A pick arm assembly 71 is mounted between end plates 42 and 43 above the spaced segment wheels 44 and 46. The pick arm assembly comprises a pick arm shaft 72 that is rotatably journaled in and extends through bearing assemblies 73 and 74 on the end plates. A first pick arm 76 and a second pick arm 77 are secured to the pick arm shaft 72 at its mid section. As described in more detail below, the pick arms 76 and 77 extend downwardly into the unobstructed space between the segment wheels 44 and 46 as shown. A first suction cup assembly 78 is mounted, preferably adjustably, to the first pick arm 76 and is positioned between the segment wheels. A second suction cup assembly 79 is mounted, again preferably adjustably, to the second pick arm 77 and likewise is positioned between the segment wheels, all as shown in FIG. 3.

A crank assembly 81 operatively links the segment wheels to the pick arm assembly and thus to the pick arms 76 and 77. More specifically, a crank wheel 83 is operatively secured to the end of the pick arm shaft 72 on the outside of end plate 42. A corresponding crank wheel 82 is secured to the end of the segment wheel shaft 49 outboard of the sprocket 54 so that the crank wheel 82 rotates with the sprocket 54 and thus with the segment wheels 44 and 46. The crank wheel 83 is provided with an off-center crank lug 87 that projects outwardly from the crank wheel. Likewise, the crank wheel 82 is provided with an off-center crank lug 86. A crank arm 84 links and is rotatably coupled to the crank lugs 86 and 87.

In operation, the crank lugs are strategically located on their respective crank wheels so that rotation of the segment wheels 44 and 46 and, consequently, rotation of the crank wheel 82 causes the pick arm crank wheel 83, and thus the pick arm shaft 72, to rotate back and forth through only a portion of a full arc. This, in turn, causes the pick arms 76 and 77 and their suction cup assemblies 78 and 79 to move or oscillate back and forth in a direction generally normal to the page in FIG. 3. The precise nature of this oscillation and its purpose is described in more detail below.

With the just described arrangement, it will be seen that when the drive shaft is rotated, the segment wheels rotate in unison while the pick arms and suction cups oscillate back and forth in the unobstructed space between the segment wheels. The nip rollers also rotate against the segment wheels and, separately, the conveyor chains are driven so that their top flight moves downstream away from the segment wheel assembly 41.

Figure 4:
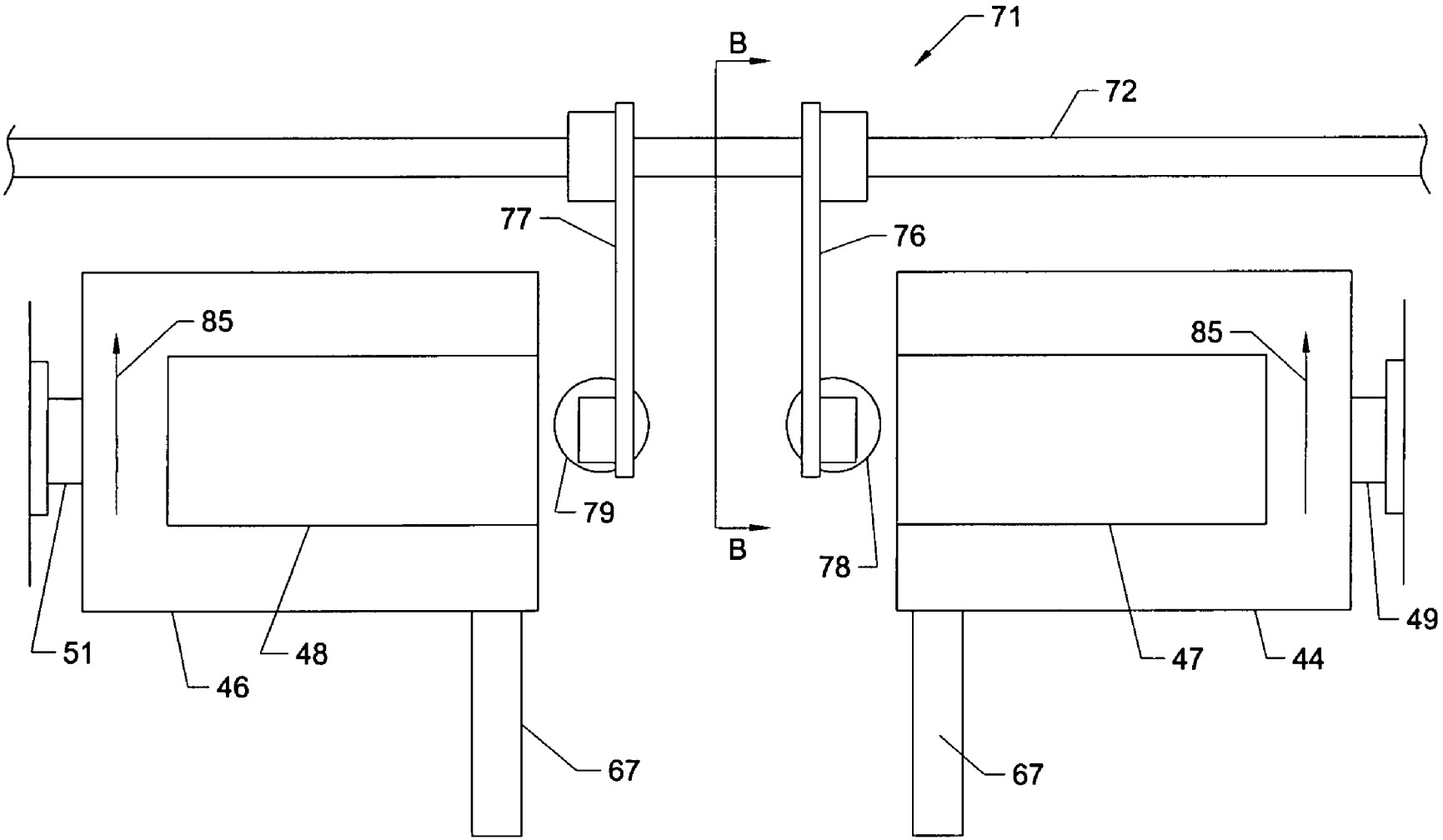
FIG. 4 is an end view of the segment wheels and pick arms of the segment wheel assembly of FIG. 3 as seen from the downstream end thereof.

FIG. 4 is an enlarged view of the segment wheels, pick arm assembly, and nip rollers of the segment wheel assembly 41, this time as seen from the upstream end of the segment wheel assembly. The cylindrical segment wheels 44 and 46 are seen rotatably mounted to the end plates as described above on individual shafts 49 and 51 respectively. The generally rectangular cutouts 47 and 48 formed in the segment wheels are more clearly visible in FIG. 4. Nip rollers 67 are rotatably mounted beneath the segment wheels and the pick arm assembly 71 is shown with its pick arm shaft 72, pick arms 76 and 77 extending into the space between the segment wheels, and suction cup assemblies 78 and 79 mounted to the lower end portions of the pick arms within the space. It should be recognized that the suction cup assemblies and their suction cups are located in the unobstructed space between the segment wheel assemblies. More importantly, they are vertically positioned at a location occupied, in the prior art, by a segment wheel shaft (see FIG. 1). Such positioning of the suction cup assemblies heretofore has not been possible, as described above, because of the requirement to avoid interference with the segment wheel shaft. In any event, as detailed above, as the segment wheels 44 and 46 are rotated in the direction indicated by arrows 85, the pick arms and suction cups oscillate back and forth in a direction generally normal to the page in FIG. 4.

Figure 5:
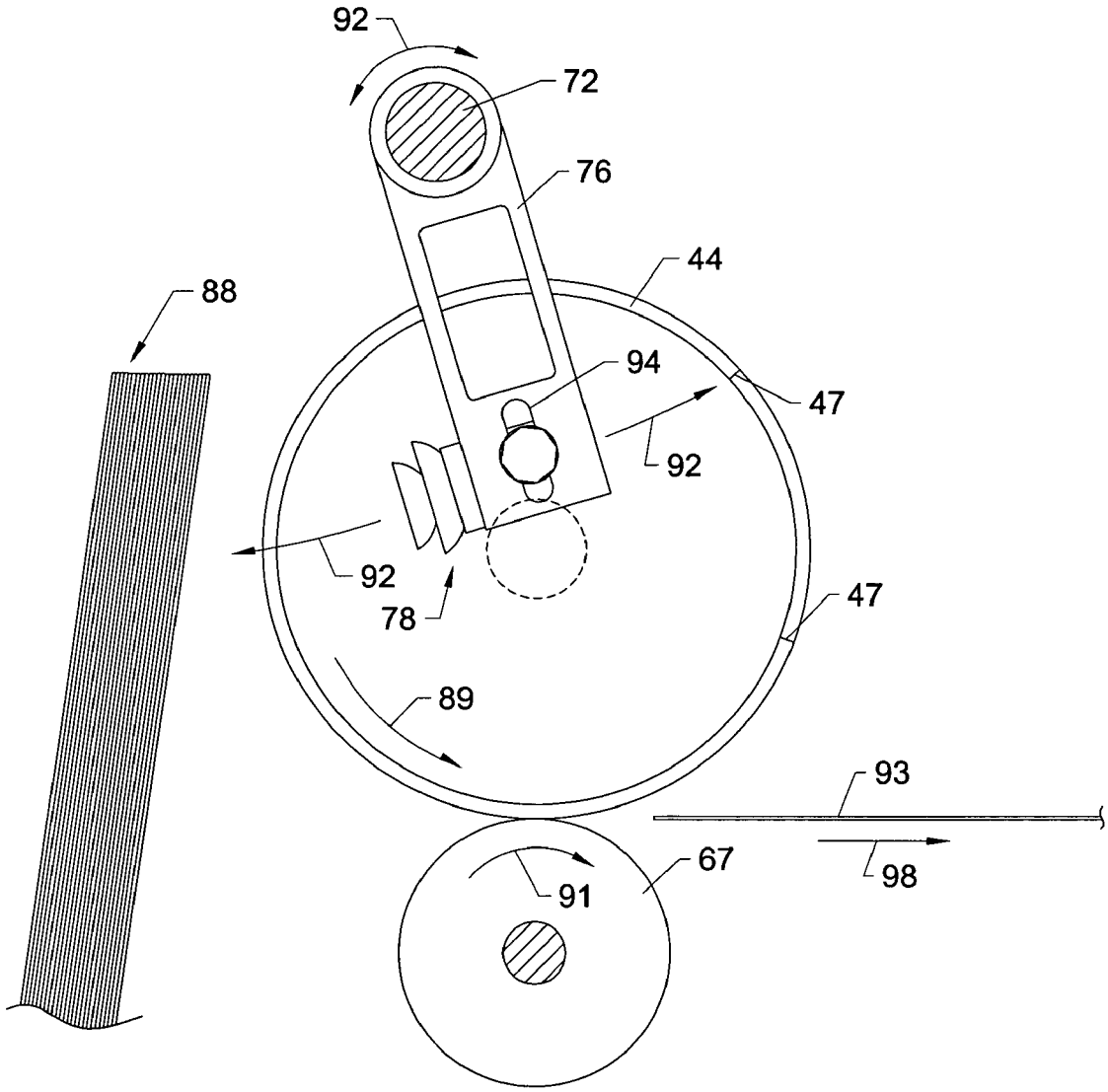
FIG. 5 is a view of the segment wheel assembly taken along line B-B of FIG. 4 and illustrating the improved operation of the segment wheel assembly of this invention.

FIG. 5 is a view taken along B-B of FIG. 4 and perhaps best illustrates the operation of the segment wheel assembly of the present invention, at least in one embodiment thereof. It should be understood that in FIG. 5 as in other figures, the elements have been simplified and many elements known in the art and not part of the invention, such as the infeed magazine, outfeed conveyor, suction lines, etc., are not shown, all for clarity of description and understanding of the invention. Referring to FIG. 5, cylindrical segment wheel 44 is seen from its open end so that the end of cutout 47 is visible around the circumference of the segment wheel 44. Pick arm 76 is mounted to pick arm shaft 72 and extends downwardly into the space between the segment wheels. In FIG. 5, pick arm 76 is illustrated as a simple straight metal arm. However, in practice, the arm can take on any of a number of application specific shapes or configurations to, for example, provide for a desired orientation and placement of the suction cup. Further, the pick arm need not be a single piece of metal but can, in fact, be a more complex multi-part assembly to provide adjustment and placement options, as needed. A suction cup assembly 78 is mounted to the lower end portion of the pick arm and, in the illustrated embodiment, is seen to be adjustable in position by means of a mounting slot 94. Nip roller 67 is mounted beneath the segment wheel 44 and rotates therewith or is separately rotated, as discussed above.

Operation of the segment wheel assembly of this invention will now be described with reference to segment wheel 44 and pick arm 76 shown in FIG. 5. Operation of the other segment wheel 46 and pick arm 77, not shown in FIG. 5, is identical. The purpose of the segment wheel assembly is to pick single carton blanks from a stack of back-to-back carton blanks 88 that are fed to the segment wheel assembly from the left in FIG. 5 (i.e. from the upstream end of the segment wheel assembly) on a magazine (not shown). Individual carton blanks are then delivered single file and in a flat edge-to-edge orientation to a conveyor (not shown) on the right or downstream end of the segment wheel assembly. As discussed above, the conveyor then carries the carton blanks to an area of the packaging machine where they are packed with product, as is known in the art.

To accomplish the above purpose, segment wheel 44 with its rectangular cutout 47 is rotated in a counterclockwise direction as indicated by arrow 89. At the same time, nip roller 67 rotates or is rotated in a clockwise direction as indicated by arrow 91. As the segment wheel 44 and nip roller 67 rotate, pick arm 76 and its suction cup assembly are oscillated by pick arm shaft 72 in a back and forth direction, as indicated by arrows 92. The timing of the rotation and oscillation, as determined by the configuration of the crank assembly, is such that the suction cup moves toward the stack 88 of carton blanks as the rectangular cutout 47 rotates around toward the blanks. The suction cup engages and grabs the end-most blank of the stack 88 and begins to oscillate back to the right in FIG. 5. This pulls the upper edge portion of the blank toward the rotating segment wheel until the upper portion of the blank engages the segment wheel. Because of the unobstructed space between the segment wheels, the suction cup can be adjusted to any desired location within the space so that it engages the carton blank at precisely the desired location, which may be near the top edge of the blank. This eliminates the bowing and attendant problems common in prior art segment wheel assemblies.

Shortly after the carton blank engages the segment wheel 44, the rectangular cutout 47 of the segment wheel 44 rotates past the upper edge portion of the blank. The upper edge portion of the blank, aided by the moving suction cup, falls and/or is pulled into the rectangular cutout at the leading edge thereof. As the segment wheel continues to rotate, the trailing edge of the rectangular cutout engages the upper edge portion of the carton blank on the back side of the blank, the suction cup disengages and moves out of the way to the right, and the trailing edge of the cutout begins to urge the upper edge portion of the carton blank downwardly toward the bottom of the segment wheel and toward the nip roller 91. When the upper edge portion of the carton blank engages the nip roller 91, it is captured by the rubberized nip roller, which ejects the carton blank to the right, as indicated at 93 and 98 in FIG. 5. During this process, the carton blank is captured by the conveyor (not shown) and conveyed downstream of the segment wheel assembly to a packing area of the packaging machine. The just described process of selecting individual carton blanks from the stack 88 repeats continuously, thereby delivering cartons continuously in horizontal, single file, edge-to-edge relationship to the conveyor.

It will thus be seen that the segment wheel assembly of this invention provides numerous advantages and improvements over prior art segment wheel assemblies of the type shown in FIGS. 1 and 2. Perhaps the primary advantage is that the unobstructed space between the segment wheels eliminates convolutedly shaped pick arms of the prior art that are configured to move around and avoid hitting a segment wheel shaft, and the consequent limited and usually lower-than-desirable suction cup positioning of the prior art. Instead, a simple pick arm or pick arm assembly can be used and the suction cup can be positioned at virtually any location between the segment wheels to engage and grab carton blanks near their upper edge portions, or at any other desired location, to obtain most efficient operation. Further, the relatively long rectangular cutouts in the cylindrical segment wheels of this invention adapt automatically to carton blanks of different widths without having to move disc-shaped segment wheels closer or further apart on their shafts as in the prior art. Narrower cartons can also be accommodated more easily with the unique spaced apart segment wheel assembly of the present invention.

The invention has been described herein in terms of preferred embodiments and methodologies considered by the inventors to be the best mode of carrying out the invention. It will be apparent to those of skill in the art, however, that various additions, deletions, and modifications might be made to the illustrated embodiments within the scope of the invention. For instance, as mentioned above, the pick arm or pick arm assembly can be shaped other than as shown or can comprise multiple components if desired to provide for appropriate range of adjustment of the suction cup assembly and other purposes. Further, while cylindrical segment wheels with rectangular cutouts are considered preferable, segment wheels of other shapes also might be substituted. For example, it may be possible to substitute traditional disc-shaped segment wheels on separate shafts with an unobstructed space between the segment wheels. Indeed segment wheels of many configurations might be substituted for the preferred cylindrical segment wheels, and such will be equivalent to the segment wheels of the preferred embodiments. Finally, while the particular drive train shown in the preferred embodiment also is preferred, other drive train configurations certainly are possible. These and other modifications to the illustrated and preferred embodiments may be made by skilled artisans without departing from the spirit and scope of the invention as set forth in the claims.

What is claimed is:

1. In a segment wheel assembly for picking single carton blanks from a magazine and delivering the blanks to a conveyor of an article packaging machine, the improvement comprising:

a first rotatable segment wheel;

a second rotatable segment wheel;

said first and second rotatable segment wheels being spaced apart from each other and defining between them an unobstructed space; and a pick arm assembly movably disposed within said unobstructed space between said first and second segment wheels.

2. The improvement of claim 1 and wherein said pick arm assembly oscillates in said unobstructed space between said segment wheels as said segment wheels rotate.

3. The improvement of claim 2 and wherein said pick arm assembly includes a suction cup configured and positioned to engage and grab single carton blanks from the magazine and pull the single carton blanks toward said rotatable segment wheels.

4. The improvement of claim 3 and wherein said first segment wheel is generally cylindrically shaped.

5. The improvement of claim 4 and wherein said second segment wheel is generally cylindrically shaped.

6. The improvement of claim 5 and wherein said first and second segment wheels have ends that oppose each other on either side of said unobstructed space.

7. The improvement of claim 6 and further comprising at least one cut-out in each of said segment wheels, said cut-out configured to engage a single carton blank pulled toward said segment wheel by said suction cup and urge the carton blank toward the conveyor.

8. The improvement of claim 7 and wherein said cut-out on each segment wheel is generally rectangular in shape.

9. The improvement of claim 4 and wherein said suction cup is adjustably mounted on said pick arm assembly so that said suction cup can be selectively positioned within said unobstructed space to accommodate differing carton blank configurations.

10. The improvement of claim 1 and further comprising a pair of pick arm assemblies disposed in said unobstructed space between said first and second segment wheels.

11. A segment wheel assembly for an article packaging machine, said segment wheel assembly comprising:

a first plate;

a second plate spaced apart from said first plate;

a first segment wheel rotatably mounted to said first plate;

a second segment wheel rotatably mounted to said second plate;

said first and second segment wheels being aligned with each other and defining an unobstructed space therebetween;

a pick arm assembly at least partially disposed within said unobstructed space between said first and second segment wheels, said pick arm assembly including at least one suction cup; and a drive train for rotating said segment wheels and simultaneously oscillating said pick arm assembly within said unobstructed space.

12. The segment wheel assembly of claim 11 and wherein said pick arm assembly includes at least one suction cup disposed in said unobstructed space.

13. The segment wheel assembly of claim 11 and wherein said segment wheels are generally cylindrical in shape.

14. The segment wheel assembly of claim 13 and wherein said generally cylindrical segment wheels have ends that oppose each other on either side of said unobstructed space.

15. The segment wheel assembly of claim 14 and further comprising a cutout in each of said generally cylindrical segment wheel assemblies.

16. The segment wheel assembly of claim 15 and wherein said cutouts are generally rectangular in shape.

17. A packaging machine comprising an carton blank magazine, a conveyor, and the segment wheel assembly of claim 11 disposed between said carton blank magazine and said conveyor.

* * * * *